United States Patent [19]

Lewis et al.

[11] 4,317,809

[45] Mar. 2, 1982

[54] CARBON FIBER PRODUCTION USING HIGH PRESSURE TREATMENT OF A PRECURSOR MATERIAL

[75] Inventors: Irwin C. Lewis, Strongsville; Arthur W. Moore, North Olmsted, both of Ohio

[73] Assignee: Union Carbide Corporation, New York, N.Y.

[21] Appl. No.: 87,186

[22] Filed: Oct. 22, 1979

[51] Int. Cl.[3] ..... D01F 9/14; C10C 3/00

[52] U.S. Cl. ..... 423/447.1; 208/39; 208/44; 264/29.2; 423/447.2; 423/447.4; 423/447.6

[58] Field of Search ..... 423/447.4, 447.1, 447.2, 423/447.6, 447.8, 449; 208/39, 44, 40, 42; 264/29.2

[56] References Cited

U.S. PATENT DOCUMENTS

| | | | |
|---|---|---|---|
| 3,928,170 | 12/1975 | Takahashi et al. | 208/40 |
| 3,974,264 | 8/1976 | McHenry | 423/447.4 |
| 4,017,327 | 4/1977 | Lewis et al. | 423/447.4 |
| 4,184,942 | 1/1980 | Angier et al. | 423/447.4 |

FOREIGN PATENT DOCUMENTS

| | | | |
|---|---|---|---|
| 1452548 | 10/1976 | United Kingdom | 423/449 |

OTHER PUBLICATIONS

Huttinger et al. "Carbon", vol. 15, 1977, pp. 69–74.

*Primary Examiner*—Edward J. Meros
*Attorney, Agent, or Firm*—David Fink

[57] ABSTRACT

A process for producing a carbon fiber includes the steps of heating a selected precursor material under high pressure, thereafter heating the precursor material under atmospheric pressure with sparging to form a mesophase pitch, spinning the mesophase pitch into at least one pitch fiber, thermosetting the pitch fiber, and carbonizing the pitch fiber to obtain the carbon fiber.

36 Claims, 1 Drawing Figure

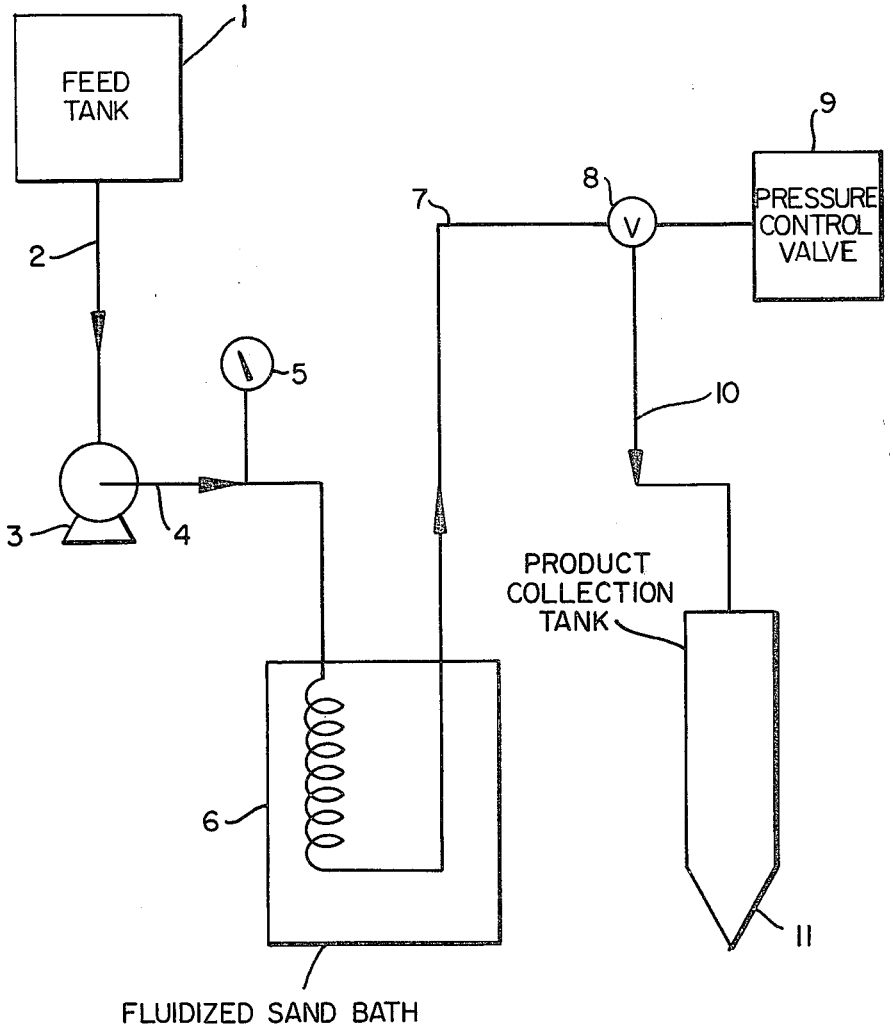
FEED TANK
1
2
3
4
5
6
7
8
V
9
PRESSURE CONTROL VALVE
10
PRODUCT COLLECTION TANK
11
FLUIDIZED SAND BATH

CARBON FIBER PRODUCTION USING HIGH PRESSURE TREATMENT OF A PRECURSOR MATERIAL

The invention relates to a process for producing a carbon fiber and particularly for producing an excellent carbon fiber from a selected precursor material which would not otherwise be suitable for forming a highly oriented carbon fiber according to conventional processes relying primarily on heating to effect thermal polymerization.

It is well known that carbon fibers having excellent properties suitable for commercial exploitation can be produced from mesophase pitch. The mesophase pitch derived carbon fibers are light weight, strong, stiff, electrically conductive, and both chemically and thermally inert. The mesophase derived carbon fibers perform well as reinforcements in composites and have found use in aerospace applications and quality sporting equipment.

Generally, carbon fibers have been primarily made commercially from three types of precursor materials: rayon, polyacrylonitrile (PAN), and pitch. The use of pitch as a precursor material is attractive economically.

Low cost carbon fibers produced from isotropic pitch exhibit little preferred molecular orientation and relatively poor mechanical properties.

In contrast, carbon fibers produced from mesophase pitch exhibit high preferred molecular orientation and relatively excellent mechanical properties.

As used herein, the term "pitch" is to be understood as used in the instant art and generally refers to a carbonaceous residue consisting of a complex mixture of primarily aromatic organic compounds which are solid at room temperature and exhibit a relatively broad melting or softening temperature range. When cooled from the melt, the pitches behave as glasses.

As used herein, the term "mesophase" is to be understood as used in the instant art and generally is synonymous with liquid crystal. That is, a state of matter which is intermediate between crystalline solid and a normal liquid. Ordinarily, material in the mesophase state exhibits both anisotropic and liquid properties.

As used herein, the term "mesophase-containing pitch" is a pitch containing less than about 40% by weight mesophase and the non-mesophase portion or isotropic phase is the continuous phase.

As used herein, the term "mesophase pitch" is a pitch containing more than about 40% by weight mesophase and is capable of forming a continuous anisotropic phase when dispersed by agitation or the like in accordance with the prior art.

A conventional method for preparing mesophase pitch suitable for forming a highly oriented carbon fiber is through the use of a precursor pitch and includes thermal treatment at a temperature greater than about 350° C. to effect thermal polymerization. This process produces large molecular weight molecules capable of forming mesophase.

The criteria for selecting a suitable precursor material for the conventional method is that the precursor pitch under quiescent conditions forms a homogeneous bulk mesophase pitch having large coalesced domains. The domains of aligned molecules are in excess of about 200 microns. This is set forth in the U.S. Pat. No. 4,005,183 to Singer.

A typical conventional method is carried out using reactors maintained at about 400° C. for from about 10 to about 20 hours. The properties of the final material can be controlled by the reaction temperature, thermal treatment time, and volatilization rate. The presence of the high molecular wieght fraction results in a melting point of the mesophase pitch of at least about 300° C. An even higher temperature is needed to transform the mesophase pitch into fibers. This is termed "spinning" in the art.

The following patents are representative of the prior art and are incorporated herein by reference:

U.S. Pat. No. 4,005,183 to Singer, U.S. Pat. No. 3,919,387 to Singer, U.S. Pat. No. 4,032,430 and U.S. Pat. No. 3,976,729 both to Lewis et al, U.S. Pat. No. 3,995,014 to Lewis, U.S. Pat. No. 3,974,264 to McHenry, and especially British Pat. No. 2,005,298 to Chwastiak.

The amount of mesophase in a pitch can be evaluated by known methods using polarized light microscopy. The presence of homogeneous bulk mesophase regions can be visually observed by polarized light microscopy, and quantitatively determined by the method disclosed in the aforementioned Chwastiak patent. Previously, the criteria of insolubility in certain organic solvents such as quinoline and pyridine was used to estimate mesophase content.

There could be present in the precursor pitch certain non-mesophase insolubles and it is a common practice to remove these insolubles before treating the precursor pitch to transorm it to mesophase pitch.

The polarized light microscopy method can also be used to measure the average domain size of a mesophase pitch. For this purpose, the average distance between disclination lines is measured and defined as the average domain size. To some degree, domain size increases with temperature up to about coking temperature. As used herein, domain size is measured for samples quiescently heated, without agitation, to about 400° C.

In accordance with the prior art, "% P.I." refers to pyridine insolubles of a pitch by Soxhlet extraction in boiling pyridine at about 115° C.

Softening point or softening temperature of a pitch, is related to its molecular weight constitution, the presence of a large amount of high molecular weight components generally tends to raise the softening temperature. It is a common practice in the art to characterize in part a precursor pitch by its softening point. For mesophase pitches, the softening point is used to determine suitable spinning temperature. Generally, the spinning temperature is about 40° C. or more higher than the softening temperature.

Generally, there are several methods for determining the softening temperature and the temperatures measured by these different methods vary somewhat from each other.

Generally, the Mettler softening point procedure is widely accepted as the standard for evaluating precursor pitches. This procedure can be adapted for use on mesophase pitches.

The softening temperature of a mesophase pitch can also be determined by hot stage microscopy. In this method, the mesophase pitch is heated on a microscope hot stage in an inert atmosphere under polarized light. The temperature of the mesophase pitch is raised under a controlled rate and the temperature at which the mesophase pitch commences to deform is noted as the softening temperature.

As used herein, softening point or softening temperature will refer to the temperature determined by the Mettler procedure for both precursor and mesophase pitches.

One of the principal objects of the invention is a process for producing a carbon fiber including the steps of heating a precursor material under high pressure, thereafter heating the precursor material under atmospheric pressure while sparging with an inert gas to form a mesophase pitch, spinning the mesophase pitch into at least one pitch fiber, thermosetting the pitch fiber, and carbonizing the pitch fiber to obtain the carbon fiber.

Preferably, the precursor materials for making the carbon fibers according to the invention include tars and distillates derived from petroleum and coal tar processes, and pure aromatic hydrocarbons. These materials are not pitches and are unsuitable for conventional thermal polymerization processes because they either produce little or no yield of mesophase pitch or the mesophase pitch obtained is characterized by a small average domain size. It is known from the prior art that a highly oriented carbon fiber can not be produced from a precursor material incapable of forming a mesophase pitch having an average domain size of at least about 200 microns.

Preferably, the precursor materials suitable for the invention are not pitches and include ethylene tar, ethylene tar distillate, coal tar, coal tar distillate, gas oil derived from petroleum refining, gas oil derived from petroleum coking, and aromatic hydrocarbons such as naphthalene, anthracene, and dimethylnaphthalene.

It is significant that the precursor materials suitable for the practice of the invention are regarded as unsuitable for use in the prior art process relying on thermal polymerization.

Generally, the first step of the invention, heating under high pressure, can be carried out in different ways. A quantity of the precursor material can be heated in a pressure vessel such as an autoclave or the precursor material can be subjected to a continuous thermal treatment under pressure.

The severity of the heating under pressure can be evaluated by the term "soaking volume factor" which is a technical term widely used in the petroleum industry for such a purpose. A soaking volume factor of 1.0 is equivalent to 4.28 hours of heating at a temperature of about 427° C. under a pressure of about 750 psig. The effect of temperature on polymerization or cracking rate of hydrocarbons is known in the art. By way of example, the cracking rate at 450° C. is 3.68 times the cracking rate at 427° C. Most of the examples given herein were carried out at a temperature near 450° C. so that the thermal treatment severity was calculated on an equivalent basis for that temperature.

For a batch thermal-pressure treatment, the preferred temperature, pressure, and soaking volume factor range depend upon the precursor materials. For distillates and tars, the temperature range is from about 400° C. to about 475° C., the pressure range is from about 200 psig to about 1500 psig, and the soaking volume factor range is from about 0.4 to about 8.6. The soaking volume factor is equivalent to from about 0.5 to about 10 hours at about 450° C.

The batch thermal-pressure treatment of the distillates and tars is discontinued when the Conradson carbon content is at least about 20% and preferably greater than about 30% but not greater than about 65%. The mesophase content is less than about 60% by weight and if infusible solids are present, a high temperature filtration is preferably carried out. For the filtration, an elevated temperature to liquify the product is used so that the infusible solids can be separated by the filtration. Preferably, stirring is used during the thermal-pressure treatment in order to maintain a homogeneous distribution.

The batch thermal-pressure treatment for precursor materials other than distillates and tars such as pure compounds is carried out for a temperature range of from about 400° C. to about 500° C. and a pressure range of from about 200 psig to about 1500 psig. The criteria for the termination of the treatment is the same as for the distillates and tars.

After the completion of the batch thermal-pressure treatment, the product can be distilled to a non-mesophase pitch preferably using a vacuum process. The distillation can be used to raise the Conradson carbon content to about 40% or more when the initial value is substantially lower. The distillation step improves the economics of the instant invention by improving the yield from the subsequent thermal polymerization step.

Preferably, the instant invention is more economical if a continuous thermal-pressure treatment is carried out instead of the batch treatment. For the continuous thermal-pressure treatment, the temperature range is from about 420° C. to about 550° C., the pressure range is from about 200 psig to about 1500 psig, and the soaking volume factor is from about 0.4 to about 2.6. The soaking volume factor corresponds to from about 0.5 to about 3 hours at a temperature of about 450° C.

The continuous thermal-pressure treatment is terminated when the Conradson carbon content of the material is at least about 5% and preferably greater than about 10% to about 15% but less than about 65%. The mesophase content is less than about 60% by weight. If infusible solids are present, a high temperature filtration is preferable.

Preferably, the product from the continuous thermal-pressure treatment is distilled to improve the Conradson carbon content to at least about 40% as described for the batch treatment process.

A product from either the batch or continuous thermal-pressure treatment is then subjected to a heat treatment in accordance with conventional thermal polymerization processes as set forth in the aforementioned patents to Lewis, McHenry, and Chwastiak. This step is carried out by heating and using a high inert gas sparging rate. The result of the thermal polymerization is a mesophase pitch having a mesophase content of at least about 70% by weight and as high as about 100% by weight.

Further objects and advantages of the invention will be set forth, in part, in the following specification and, in part, will be obvious therefrom without being specifically referred to, the same being realized and attained as pointed out in the claims hereof.

For a fuller understanding of the nature and objects of the invention, reference should be had to the following detailed description, taken in connection with the accompanying FIGURE showing a simplified flow diagram of a continuous thermal-pressure treatment system for use in carrying out the invention.

In carrying the invention into effect, certain embodiments have been selected for illustration in the accompanying drawing and for description in this specification.

Illustrative, non-limiting examples of the invention are set out below. Numerous other examples can readily be evolved in the light of the guiding principles and teaching herein. The examples given herein are intended to illustrate the invention and not in any sense to limit the manner in which the invention can be practiced. The parts and percentages recited herein, unless specifically stated otherwise, refer to parts by weight and percentages by weight.

The FIGURE shows a simplified flow system for carrying out the continuous thermal-pressure treatment of a precursor material. The precursor material is placed in feed tank 1. The feed tank 1 can include heaters if desired for heating the precursor material to lower its viscosity and thereby improve its flow. The feed tank 1 is connected by line 2 to a pump 3 which pumps the precursor material through line 4 and is monitored by a pressure gauge 5.

The precursor material moves through a furnace coil in a fluidized sand bath 6. If a longer treatment is desired, several fluidized sand baths can be used in tandem.

The treated precursor material moves through line 7 to valve 8 which is controlled by a pressure control 9 and is collected through line 10 in a product collection tank 11 for subsequent steps of the invention.

EXAMPLE 1

An ethylene tar derived from the steam-cracking of naphtha was selected for the precursor material. The ethylene tar was batch thermal-pressure treated at a temperature of about 435° C. under a pressure of about 750 psig in a 2 liter autoclave for about 6 hours. A viscous tar product which contained a small amount of solids was obtained in a yield of about 70% by weight based on the initial batch. This material had a Conradson carbon content of about 46%. A portion of this material was thermal-treated at about 400° C. for about 6 hours in a small ceramic boat in an inert atmosphere of nitrogen at atmospheric pressure. The resulting product was then examined by polarized light microscopy and was seen to exhibit large anisotropic domains with an average domain size of about 380 microns.

The test of a portion of the product of the thermal-pressure treatment showed that a satisfactory mesophase pitch could be produced from continuing the steps of the invention.

Before performing the conventional thermal polymerization step, however, the tar product was heated at a temperature of about 390° C. for about 18 hours with continuous agitation at the rate of about 300 rpm and a sparging rate of about one liter per minute with argon. A yield of about 43% by weight of mesophase pitch was obtained and had a softening point of about 360° C., 62% P.I., and about 100% by weight mesophase content.

For comparison sake, a sample of the same ethylene tar was heat-treated at a temperature of about 370° C. in a reactor at atmospheric pressure of nitrogen for about 2 hours with continuous stirring. Then, the product was heated at a temperature of about 400° C. for six hours and resulted in a pitch exhibiting an average anisotropic domain size of about 25 microns. It is known from the aforementioned Singer patent that a domain size of about 25 microns is unsuitable for spinning mesophase pitch fibers.

The mesophase pitch was further treated in the same reactor at a temperature of about 380° C. for about 11 hours with 300 rpm agitation and argon sparge of about 2 liters per minute. The mesophase pitch obtained had a softening point of about 368° C., 47% P.I., and about 30% by weight mesophase content. The combination of the high softening point 368° C. with the low mesophase content makes this product unsuitable for spinning. If the pitch had been heated further, a higher mesophase content up to about 100% by weight might be obtainable, but the softening temperature would certainly exceed about 400° C. and thereby make the resultant mesophase pitch unsuitable for spinning.

EXAMPLE 2

A coal tar distillate having a boiling range of about 300° C. to about 390° C. was batch thermal-pressure treated in an autoclave by maintaining a temperature of about 450° C. for about 4 hours with a pressure of about 400 psig. The product obtained amounted to a yield of about 35% by weight and had a softening point of about 80° C. The Conradson carbon content was about 32% and the product was shown to be capable of forming mesophase pitch having a domain size of about 290 microns by the test of the Example 1.

The product was then thermally polymerized in a reactor at a temperature of about 390° C. for about 25 hours with agitation of about 300 rpm and sparging with argon at a rate of about one liter per minute at atmospheric pressure. A yield of about 49% by weight was obtained and the mesophase pitch had a softening point of about 351° C., 48% P.I., and about 100% by weight mesophase content.

The mesophase pitch was spun into monofilament fibers having an average diameter of about 13 microns. The fibers were thermoset by heating in air at a rate of about 2° C. per minute to about 375° C. The thermoset fibers were then carbonized at a temperature of about 1700° C. in an inert atmosphere of nitrogen in accordance with conventional methods and the carbonized fibers exhibited a modulus of about $18\times10^6$ psi and a tensile strength of about 250,000 psi.

EXAMPLE 3

A coal tar distillate having a boiling range of from 240° C. to about 390° C. was subjected to the continuous thermal-pressure treatment. The distillate was heated to a maximum temperature of about 515° C. at a pressure of about 750 psig and a soaking volume factor of about 0.8 which is equivalent to about 0.9 hours at about 450° C. The total liquid product of the thermal-pressure treatment was vacuum distilled to a final vapor temperature of about 370° C. (atmospheric pressure equivalent). The Conradson carbon content of the resultant pitch was about 5.4%.

The product was shown to produce a mesophase pitch which exhibited a mesophase domain size of about 290 microns.

The next step of thermal treatment was carried out on the pitch at atmospheric pressure in argon at a temperature of about 390° C. for about 24 hours with agitation and a sparge rate as in the Example 2.

The mesophase pitch obtained had a softening point of about 342° C., 49% P.I., and a mesophase content of about 98% by weight.

EXAMPLE 4

An ethylene tar distillate derived from the cracking of naphtha, having a boiling range of from about 200° C. to about 360° C. was treated in an autoclave with stirring at a pressure of about 750 psig and a reaction temperature of about 455° C. for about 7 hours. A viscous tar product with a small amount of solids was obtained in a yield of about 55% by weight. The Conradson carbon content was about 21%.

The tar product was filtered at an elevated temperature through a fritted glass funnel to remove the solids and the filtered tar was distilled under a vacuum to produce a pitch having a softening point of about 118° C. This pitch was shown to produce a mesophase pitch having a domain size of about 340 microns.

The distilled pitch was converted to a mesophase pitch in a standard reaction system at a temperature of 390° C. for 30 hours with an agitation rate of about 300 rpm and argon sparging at the rate of about one liter per minute.

The mesophase pitch had a softening point of about 337° C., 47% P.I., and a mesophase content of about 98% by weight.

The mesophase pitch was spun into fibers having an average diameter of about 10 microns. In accordance with conventional methods, the pitch fibers were thermoset and then carbonized at temperatures of about 1700° C. to form carbon fibers having a modulus of about $25\times10^6$ psi, and a tensile strength of about 340,000 psi.

EXAMPLE 5

The ethylene tar distillate of the Example 4 was subjected to a continuous thermal-pressure treatment with a maximum temperature of about 530° C. and pressure of about 750 psig and a soaking volume factor of about 1.0 which is equivalent to about 1.2 hours at about 450° C. The resulting product has a Conradson carbon content of about 5%. The liquid product was then vacuum distilled to a final vapor temperature of about 370° C. (atmospheric pressure equivalent).

Following the test procedure of the Example 1, a mesophase pitch was obtained to evaluate the domain size. The average mesophase domain size was measured to be about 350 microns. The distilled pitch was then subjected to a temperature of about 390° C. for about 29 hours with stirring and sparging as in the Example 4.

The mesophase pitch obtained had a softening point of about 337° C., 49% P.I., and a mesophase content of about 100% by weight.

EXAMPLE 6

A gas oil having a boiling range of from about 250° C. to about 450° C. derived from a delayed petroleum coking operation was heated in a stirred pressure autoclave at a pressure of about 300 psig at a temperature of about 450° C. for about 4 hours. The product had a Conradson carbon content of about 28%. The product was then vacuum distilled to give a pitch having a softening point of about 66° C. By the test described herein, the mesophase domain size of the mesophase pitch derived from the product was about 210 microns.

The distilled pitch was then converted to a mesophase pitch at a temperature of about 390° C. for about 26 hours in accordance with conventional methods.

The mesophase pitch obtained had a softening point of about 355° C., 49% P.I., and a meshophase content of about 90% by weight.

EXAMPLE 7

A petrochemical naphthalene was subjected to a batch thermal-pressure treatment at a temperature of about 500° C. for about 50 hours with the pressure rising to a maximum of about 1330 psig due to the pressure generated from the vapor pressure of naphthalene and to decomposition products. A yield of about 75% by weight of a product was obtained with a Conradson carbon content of about 31%. A portion of this product was distilled at atmospheric pressure to remove unreacted naphthalene and other low molecular weight hydrocarbons so that a 50% by weight yield was obtained which had a softening point of about 120° C. A portion of this product was tested by the aforementioned procedure. The mesophase pitch obtained had a mesophase domain size of about 420 microns. This indicated that a good mesophase pitch suitable for producing a highly oriented carbon fiber would be obtained from further treatment.

The product was then converted into a mesophase pitch in a conventional reaction system having an agitation rate of about 300 rpm, argon sparging at the rate of about one liter per minute, a temperature of about 390° C., and a reaction time of about 30 hours.

The mesophase pitch obtained amounted to a yield of about 59% by weight, had a softening point of about 331° C., 51% P.I., and a mesophase content of about 100% by weight.

EXAMPLE 8

A coal tar distillate having a boiling range of from about 230° C. to about 370° C. was batch treated at a temperature of about 455° C. for about 5 hours with a pressure of about 750 psig with stirring. The product obtained had a Conradson carbon content of about 25% and was filtered to remove a small amount of solids present. The product was then vacuum distilled to a vapor temperature of about 370° C. (atmospheric equivalent) and a softening point of about 100° C. The mesophase domain size was about 270 microns by the usual test.

The product was then subjected to conventional thermal polymerization at a temperature of about 390° C. for about 25 hours to result in a mesophase pitch having a softening point of about 349° C., 49% P.I., and a mesophase content of about 100% by weight.

EXAMPLE 9

A coal tar distillate was subjected to a temperature of about 450° C. at a pressure of 750 psig for about 5 hours with stirring. The product had a Conradson carbon content of about 24%. The product was filtered to remove solids and then vacuum distilled to provide a pitch having a Conradson carbon content of about 50%. By the usual test, the mesophase domain size was about 570 microns.

The product was converted to a mesophase pitch at a temperature of 390° C. for 22 hours in accordance with conventional methods.

The mesophase pitch obtained had a softening point of 345° C., 50% P.I., and a mesophase content of about 100% by weight.

EXAMPLE 10

An ethylene tar distillate having a boiling range of from 210° C. to about 330° C. was batch heated with stirring at a temperature of about 455° C. under a pressure of about 850 psig for about 5 hours. The viscous tar product had a Conradson carbon content of about 23% and was filtered and then vacuum distilled to obtain a pitch having a softening point of about 123° C. with a Conradson carbon content of about 60%. The mesophase domain size by the usual test was about 270 microns.

The distilled pitch was converted to a mesophase pitch at a temperature of 390° C. for 24 hours in accordance with conventional methods.

The mesophase pitch had a softening point of about 344° C., 51% P.I., and a mesophase content of about 100% by weight.

The mesophase pitch was spun into pitch fibers having an average diameter of about 10 microns and thereafter thermoset and carbonized to 1700° C. in accordance with conventional methods. The carbon fibers had a modulus of about $23\times10^6$ psi and a tensile strength of about 380,000 psi.

EXAMPLE 11

A gas oil derived from delayed petroleum coking, having a boiling range of from about 180° C. to about 450° C. was heated at a temperature of about 445° C. under a pressure of about 300 psig for about 4 hours to obtain a product having a Conradson carbon content of about 27%. This product was filtered to remove small amounts of solids and was then vacuum distilled to a 370° C. boiling temperature (atmospheric equivalent). The distilled product had a softening point of about 40° C. with a Conradson carbon content of about 36%. By the usual test, the mesphase domain size was measured to be about 400 microns.

The distilled pitch was converted to a mesophase pitch at 390° C. for 24 hours in accordance with conventional methods. The mesophase pitch had a softening point of about 350° C., 51% P.I., and a mesophase content of about 95% by weight.

EXAMPLE 12

The gas oil of the Example 11 was subjected to a continuous thermal-pressure treatment with a maximum temperature of about 520° C. under a pressure of about 750 psig and a soaking volume factor of 1.1 for an equivalent severity of heat treatment of about 1.3 hours at 450° C. The entire liquid product had a Conradson carbon content of about 5%. The product was distilled to form a pitch having a Conradson carbon content of about 33% and a mesophase domain size by the usual test was measured to be about 230 microns.

The distilled pitch was converted to a mesophase pitch at a temperature of about 390° C. for about 26 hours in accordance with conventional methods. The mesophase pitch obtained had a softening point of about 334° C., 52% P.I., and a mesophase content of about 88% by weight,

EXAMPLE 13

A mixture of dimethylnaphalenes was heated in a stirred autoclave at a temperature of about 465° C. under a pressure of about 800 psig for about 5 hours. The product had a Conradson carbon content of about 22% and was filtered and vacuum distilled to obtain a pitch having a Conradson carbon content of about 52%. The mesophase domain size, by the usual test was about 250 microns.

The distilled pitch was converted to a mesophase pitch at a temperature of about 390° C. for 24 hours in accordance with conventional methods. The mesophase pitch had a softening point of about 342° C., 55% P.I., and a mesophase content of about 100% by weight.

EXAMPLE 14

A commercial anthracene was heated at a temperature of 440° C. under a pressure of about 800 psig for about 5 hours. The product had a Conradson carbon content of about 56% and by the usual test, a mesophase domain size of about 510 microns.

The product was converted to a mesophase pitch by heating at 390° C. for about 6 hours in accordance with conventional methods. The mesophase pitch had a softening point of about 325° C., 66% P.I., and a mesophase content of about 90% by weight.

Having thus described the invention, what we claim as new and desire to be secured by Letter Patent, is as follows:

1. A process for producing a carbon fiber, comprising the steps of:

subjecting a precursor material selected from the group consisting of ethylene tar, ethylene tar distillate, and gas oil to a thermal-pressure treatment as a batch treatment for a temperature range from about 400° C. to about 475° C. and for a pressure from about 200 psig to about 1500 psig;

thereafter, subjecting the precursor material to heating under atmospheric pressure while sparging with an inert gas to form a mesophase pitch;

spinning the mesophase pitch into at least one pitch fiber; and converting the pitch fiber into the carbon fiber.

2. The process of claim 1, wherein the pitch fiber is subjecting to thermosetting and then carbonized to the carbon fiber.

3. The process of claim 1, wherein the soaking volume factor for the thermal-pressure treatment is from about 0.4 to about 8.6.

4. The process of claim 3, wherein the thermal-pressure treatment is continued until the Conradson carbon content of the precursor material is from about 20% to about 65%.

5. The process of claim 4, wherein the Conradson carbon content is at least about 30%.

6. The process of claim 4, wherein the thermal-pressure treatment is carried out with the precursor material being agitated.

7. The process of claim 6, wherein the agitation is in the form of stirring.

8. The process of claim 4, further comprising filtering the precursor material subsequent to the thermal-pressure treatment to remove infusible solids.

9. The process of claim 4, further comprising distilling the precursor material subsequent to the thermal-pressure treatment.

10. The process of claim 9, wherein the distilling raises the Conradson carbon content of the precursor material to at least 40%.

11. A process of producing a carbon fiber, comprising the steps of:

subjecting a precursor material selected from the group consisting of napthalene, anthracene, and dimethylnaphthalenes to a thermal-pressure treatment as a batch treatment for a temperature from about 400° C. to about 500° C. and for a pressure from about 200 psig to about 1500 psig;

thereafter, subjecting the precursor material to heating under atmospheric pressure while sparging with an inert gas to form a mesophase pitch;

spinning the mesophase pitch into at least one pitch fiber; and converting the pitch fiber into the carbon fiber.

12. The process of claim 11, wherein the soaking volume factor for the thermal-pressure treatment is from about 0.4 to about 8.6.

13. The process of claim 12, wherein the thermal-pressure treatment is continued until the Conradson carbon content of the precursor material is from about 20% to about 65%.

14. The process of claim 13, wherein the Conradson carbon content is at least about 30%.

15. The process of claim 13, wherein the thermal-pressure treatment is carried out with the precursor material being agitated.

16. The process of claim 15, wherein the agitation is in the form of stirring.

17. The process of claim 13, further comprising filtering the precursor material subsequent to the thermal-pressure treatment to remove infusible solids.

18. The process of claim 13, further comprising distilling the precursor material subsequent to the thermal-pressure treatment.

19. The process of claim 18, wherein the distilling raises the Conradson carbon content of the precursor material to at least 40%.

20. A process for producing a carbon fiber, comprising the steps of:

subjecting a precursor material selected from the group consisting of ethylene tar, ethylene tar distillate, and gas oil, to a thermal-pressure treatment as a continuous treatment for a termperature from about 420° C. to about 550° C. and for a pressure from about 200 psig to about 1500 psig;

thereafter, subjecting the precursor material to heating under atmospheric pressure while sparging with an inert gas to form a mesophase pitch;

spinning the mesophase pitch into at least one pitch fiber; and converting the pitch fiber into the carbon fiber.

21. The process of claim 20, wherein the soaking volume factor for the thermal-pressure treatment is from about 0.4 to about 2.6.

22. The process of claim 21, wherein the thermal-pressure treatment is continued until the Conradson carbon content of the precursor material is from about 5% to about 65%.

23. The process of claim 22, wherein the Conradson carbon content is at least about 10%.

24. The process of claim 22, further comprising filtering the precursor material subsequent to the thermal-pressure treatment to remove infusible solids.

25. The process of claim 22, further comprising distilling the precursor material subsequent to the thermal-pressure treatment.

26. The process of claim 25, wherein the distilling raises the Conradson carbon content of the precursor material to at least 40%.

27. A process for producing a mesophase pitch comprising the steps of:

subjecting a precursor material selected from the group consisting of ethylene tar, ethylene tar distillate, and gas oil to thermal-pressure treatment as a batch treatment for a temperature from about 400° C. to about 475° C. and for a pressure from about 200 psig to about 1500 psig; and thereafter, subjecting the precursor material to heating under atmospheric pressure while sparging with an inert gas to form the mesophase pitch.

28. A process for producing a mesophase pitch comprising the steps of:

subjecting a precursor material selected from the group consisting of napthalene, anthracene, and dimethylnaphthalenes to a thermal-pressure treatment as a batch treatment at a temperature from about 400° C. to about 500° C. and for a pressure from about 200 psig to about 1500 psig; and thereafter, subjecting the precursor material to heating under atmospheric pressure while sparging with an inert gas to form the mesophase pitch.

29. The process of claim 28, wherein the soaking volume factor for the thermal-pressure treatment is from about 0.4 to about 8.6.

30. The process of claim 29, wherein the thermal-pressure treatment is continued until the Conradson carbon content of the precursor material is from about 20% to about 65%.

31. The process of claim 30, wherein the Conradson carbon content is at least about 30%.

32. The process of claim 30, wherein the thermal-pressure treatment is carried out with the precursor material being agitated.

33. The process of claim 32, wherein the agitation is in the form of stirring.

34. The process of claim 30, further comprising filtering the precursor material subsequent to the thermal-pressure treatment to remove infusible solids.

35. The process of claim 30, further comprising distilling the precursor material subsequent to the thermal-pressure treatment.

36. The process of claim 35, wherein the distilling raises the Conradson carbon content of the precursor material to at least 40%.

* * * * *